US011391523B2

(12) United States Patent
Stillman et al.

(10) Patent No.: US 11,391,523 B2
(45) Date of Patent: Jul. 19, 2022

(54) ASYMMETRIC APPLICATION OF COOLING FEATURES FOR A CAST PLATE HEAT EXCHANGER

(71) Applicant: United Technologies Corporation, Farmington, CT (US)

(72) Inventors: William P. Stillman, Sturbridge, MA (US); Michael A. Disori, Glastonbury, CT (US); Matthew A. Devore, Rocky Hill, CT (US); Dave J. Hyland, Portland, CT (US); Adam J. Diener, Marlborough, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/276,801

(22) Filed: Feb. 15, 2019

(65) Prior Publication Data

US 2019/0293367 A1 Sep. 26, 2019

Related U.S. Application Data

(60) Provisional application No. 62/647,116, filed on Mar. 23, 2018.

(51) Int. Cl.
*F28F 3/08* (2006.01)
*F28F 3/02* (2006.01)
(Continued)

(52) U.S. Cl.
CPC ..... *F28F 3/08* (2013.01); *F28F 1/022* (2013.01); *F28F 1/42* (2013.01); *F28F 1/422* (2013.01);
(Continued)

(58) Field of Classification Search
CPC .... F28F 3/08; F28F 3/048; F28F 1/022; F28F 1/42; F28F 1/422; F28F 3/027; F28F 2215/10; F28F 2215/00
See application file for complete search history.

(56) References Cited

U.S. PATENT DOCUMENTS 813,918 A * 2/1906 Schmitz ..... F28D 7/106 165/141
1,343,352 A * 6/1920 Costelloe ..... F28D 1/05333 165/179
(Continued)

FOREIGN PATENT DOCUMENTS

EP 0248222 A2 12/1987
EP 3889533 A1 * 10/2021 ..... F28D 1/05383
JP S60238684 A 11/1985

OTHER PUBLICATIONS

European Search Report for EP Application No. 19164136.4 dated Sep. 17, 2019.

*Primary Examiner* — Ljiljana V. Ciric
(74) *Attorney, Agent, or Firm* — Carlson, Gaskey & Olds, P.C.

(57) ABSTRACT

A cast plate heat exchanger includes an inner surface of a passage with a first group of augmentation features with a first density across the inner surface. An outer surface includes a second inlet end and a second group of augmentation features arranged with a second density across the outer surface. The first density and second density of augmentation features are located in a targeted manner to reduce thermal stresses.

16 Claims, 6 Drawing Sheets

(51) Int. Cl.
*F28F 3/04* (2006.01)
*F28F 1/02* (2006.01)
*F28F 1/42* (2006.01)

(52) U.S. Cl.
CPC ..... *F28F 3/027* (2013.01); *F28F 3/048* (2013.01); *F28F 2215/00* (2013.01); *F28F 2215/10* (2013.01)

(56) References Cited

U.S. PATENT DOCUMENTS 1,365,438 A * 1/1921 Adamson ..... F01M 11/065 184/104.3
1,376,882 A * 5/1921 Hromadko ..... F28D 1/0316 165/153
1,519,673 A * 12/1924 Doble ..... F24H 3/087 126/90 R
1,777,782 A * 10/1930 Bundy ..... B21C 37/124 165/179
1,935,332 A * 11/1933 Quarnstrom ..... F28F 9/22 165/151
2,362,571 A * 11/1944 McCollum ..... B64D 13/08 126/116 R
2,389,166 A * 11/1945 Seaver ..... F28D 17/02 165/9.1
2,405,722 A * 8/1946 Villier ..... F28F 1/14 165/122
2,414,557 A * 1/1947 Reed ..... F24H 1/38 122/223
2,432,308 A * 12/1947 Goodyer ..... F28F 1/422 210/179
2,467,668 A * 4/1949 Hallberg ..... B21C 37/30 72/479
2,577,188 A * 12/1951 Hall ..... F01M 11/0004 184/106
2,703,921 A * 3/1955 Brown, Jr. ..... F28D 7/103 29/890.036
2,717,320 A * 9/1955 Shoulders ..... H02K 9/18 310/57
2,895,508 A * 7/1959 Drake ..... F28F 1/40 138/38
2,905,447 A * 9/1959 Huet ..... F28F 1/422 165/165
2,929,408 A * 3/1960 Smith ..... F28F 13/06 138/38
2,930,405 A * 3/1960 Welsh ..... F28F 13/06 138/38
3,002,729 A * 10/1961 Welsh ..... F28F 1/20 165/183
3,136,037 A * 6/1964 Solnick ..... F28F 3/14 29/890.042
3,267,564 A * 8/1966 Keyes ..... F28F 21/084 29/890.036
3,301,319 A * 1/1967 Merrill ..... F28F 9/20 165/133
3,705,617 A * 12/1972 Miller ..... B01D 7/02 165/179
3,817,354 A * 6/1974 Meiners ..... F01M 11/0004 184/104.3
3,908,603 A * 9/1975 Schiffelers ..... F24H 1/38 122/209.1
3,993,126 A * 11/1976 Taylor ..... F28F 9/162 165/173
4,022,162 A * 5/1977 Escaro ..... F22B 7/12 122/182.3
4,022,272 A * 5/1977 Miller ..... F01P 11/08 165/51
4,157,698 A * 6/1979 Viessmann ..... F24H 1/263 122/136 R
4,169,431 A * 10/1979 Viessmann ..... F24H 1/263 122/136 R
4,282,833 A * 8/1981 Giesen ..... F24H 1/32 122/158
4,296,539 A * 10/1981 Asami ..... F16L 9/19 165/115
4,306,619 A * 12/1981 Trojani ..... F28F 1/42 165/179
4,345,644 A * 8/1982 Dankowski ..... F28D 1/0246 165/154
4,356,794 A * 11/1982 Bouman ..... F24H 8/00 122/158
4,470,455 A * 9/1984 Sacca ..... F28F 3/04 165/167
4,653,572 A * 3/1987 Bennett ..... F25J 3/04412 165/133
4,657,074 A * 4/1987 Tomita ..... F24H 3/065 165/179
4,696,342 A * 9/1987 Yamauchi ..... F28D 1/0341 165/152
4,751,964 A * 6/1988 Borbely ..... F28D 9/0037 165/147
4,778,002 A * 10/1988 Allgauer ..... F28F 1/42 165/141
4,782,892 A * 11/1988 Ostbo ..... F28D 7/0041 165/164
4,821,797 A * 4/1989 Allgauer ..... F28F 1/422 165/141
4,886,018 A * 12/1989 Ferroli ..... F24H 1/32 122/367.3
4,898,261 A * 2/1990 Winberg ..... F01M 5/002 123/195 C
5,855,240 A * 1/1999 Farrell ..... F28D 1/035 165/76
5,937,817 A * 8/1999 Schanz ..... F01M 11/0004 123/196 AB
6,047,769 A * 4/2000 Shimoya ..... F28D 1/0333 165/148
6,070,657 A * 6/2000 Kunkel ..... F28F 21/082 165/158
6,157,778 A * 12/2000 Kadotani ..... F24H 1/142 392/483
6,187,185 B1 * 2/2001 Lee ..... B01D 35/0273 184/6.24
6,202,736 B1 * 3/2001 Fast ..... F16H 57/0415 165/185
6,286,465 B1 * 9/2001 Hughes ..... F23M 9/003 122/155.2
6,289,982 B1 * 9/2001 Naji ..... F28D 1/0341 165/153
6,318,455 B1 * 11/2001 Nakado ..... F28F 3/044 165/153
6,321,792 B1 * 11/2001 Von Huth Smith ..... F28F 1/12 138/38
6,438,936 B1 * 8/2002 Ryan ..... F02C 7/10 60/39.511
6,691,831 B1 * 2/2004 Furuya ..... F01M 5/002 123/196 AB
6,938,685 B2 * 9/2005 Duerr ..... F28D 1/0333 165/148
7,044,210 B2 * 5/2006 Usui ..... F28D 7/1607 138/177
7,148,452 B2 * 12/2006 Peterson ..... H05K 7/20918 219/443.1
7,588,074 B1 * 9/2009 White ..... E04H 7/30 165/166
7,637,337 B2 * 12/2009 Stranges ..... F01M 11/0004 180/69.1
8,235,098 B2 * 8/2012 Agee ..... F28D 7/1684 165/148
8,757,103 B2 * 6/2014 Cool ..... F24H 1/52 122/235.12
8,770,269 B2 * 7/2014 Scott ..... F28D 1/0233 165/164
8,939,683 B1 * 1/2015 White ..... F28F 3/12 407/61
9,077,056 B2 * 7/2015 Marchio ..... H01M 10/655
9,377,250 B2 6/2016 Landre
9,437,905 B2 * 9/2016 Boddakayala ..... H01M 10/625
9,745,069 B2 * 8/2017 Shea ..... B64D 15/06

(56) References Cited

U.S. PATENT DOCUMENTS 9,777,963 B2 * 10/2017 Martinez ..... F28F 9/0224
9,835,380 B2 * 12/2017 Kupiszewski ..... F28D 1/05375
10,006,369 B2 * 6/2018 Kupiszewski ..... F02C 7/18
10,175,003 B2 * 1/2019 Sennoun ..... F28F 7/02
10,184,702 B2 * 1/2019 Dassler ..... F25B 17/08
10,316,750 B2 * 6/2019 Loebig ..... F28F 3/048
10,378,835 B2 * 8/2019 Kenworthy ..... F28F 13/02
10,502,502 B2 * 12/2019 Sennoun ..... F28D 1/05391
10,520,261 B2 * 12/2019 Brunner ..... F28F 1/40
10,578,374 B2 * 3/2020 Baker ..... F28D 1/0475
10,605,543 B2 * 3/2020 Schnabel ..... F28F 13/003
10,612,414 B2 * 4/2020 Roberge ..... F28F 3/086
10,690,420 B2 * 6/2020 Zhang ..... F28F 9/182
10,823,511 B2 * 11/2020 Vargas ..... F28D 9/0093
10,830,540 B2 * 11/2020 Sennoun ..... F28D 1/05391
10,907,500 B2 * 2/2021 Wong ..... F01D 25/12
11,209,224 B2 * 12/2021 Stillman ..... F28F 1/26
2002/0029871 A1 * 3/2002 Kern ..... F28D 1/0535 165/151
2003/0033990 A1 * 2/2003 Inoue ..... F23M 5/04 122/6 A
2003/0159806 A1 * 8/2003 Sehmbey ..... F28F 3/027 165/80.3
2004/0099712 A1 5/2004 Tonkovich et al.
2005/0120715 A1 * 6/2005 Labrador ..... F02C 1/05 60/618
2008/0149313 A1 * 6/2008 Slaughter ..... B22F 10/20 430/269
2009/0218086 A1 * 9/2009 Sciorelli ..... F28D 7/1623 165/181
2010/0162967 A1 * 7/2010 Taylor ..... F24H 1/32 122/367.1
2010/0242863 A1 * 9/2010 Hubau ..... F24H 9/0026 122/367.1
2011/0108253 A1 * 5/2011 Cool ..... F24H 1/52 165/151
2012/0090563 A1 * 4/2012 Thijssen ..... B22C 7/065 122/367.1
2014/0096938 A1 * 4/2014 Kojima ..... F28F 1/00 165/104.19
2014/0110085 A1 * 4/2014 Deckers ..... F28F 1/022 165/80.1
2014/0116664 A1 5/2014 Landre
2014/0260218 A1 * 9/2014 Deckers ..... F01K 5/02 60/320
2015/0050520 A1 * 2/2015 Niikura ..... C22F 1/043 428/654
2015/0121701 A1 * 5/2015 Loong ..... B21J 5/068 29/890.035
2016/0069622 A1 * 3/2016 Alexiou ..... B22F 5/10 165/146
2016/0110881 A1 4/2016 Ben Dov et al.
2016/0230595 A1 8/2016 Wong et al.
2017/0137919 A1 * 5/2017 Niikura ..... C22F 1/043
2017/0152751 A1 6/2017 Spangler et al.
2017/0333941 A1 11/2017 Park et al.
2017/0343301 A1 * 11/2017 Petela ..... C22C 30/00
2018/0045472 A1 * 2/2018 MacLellan ..... F28D 9/0062
2018/0073813 A1 * 3/2018 Ranjan ..... F28F 7/02
2018/0209635 A1 * 7/2018 Luiten ..... F21V 29/713
2018/0299210 A1 * 10/2018 Ronacher ..... F28F 3/025
2018/0340743 A1 * 11/2018 Poltorak ..... H01L 23/36
2018/0372416 A1 * 12/2018 Vargas ..... F28F 1/26
2019/0021186 A1 * 1/2019 Poltorak ..... H01L 23/473
2019/0036301 A1 * 1/2019 Shawgo ..... H01S 5/02469
2019/0277571 A1 * 9/2019 Disori ..... F28F 9/04
2019/0277579 A1 * 9/2019 Disori ..... F28D 1/05383
2019/0277580 A1 * 9/2019 Disori ..... F28F 3/027
2019/0293365 A1 * 9/2019 Disori ..... F28F 1/26
2019/0293366 A1 * 9/2019 Disori ..... F28F 3/04
2019/0293367 A1 * 9/2019 Stillman ..... F28F 3/08
2020/0025467 A1 * 1/2020 Disori ..... F28D 7/1653

* cited by examiner

ASYMMETRIC APPLICATION OF COOLING FEATURES FOR A CAST PLATE HEAT EXCHANGER

CROSS-REFERENCE TO RELATED APPLICATION

This application claims priority to U.S. Provisional Application No. 62/647,116 filed on Mar. 23, 2018.

BACKGROUND

A plate fin heat exchanger includes adjacent flow paths that transfer heat from a hot flow to a cooling flow. The flow paths are defined by a combination of plates and fins that are arranged to transfer heat from one flow to another flow. The plates and fins are created from sheet metal material brazed together to define the different flow paths. Thermal gradients present in the sheet material create stresses that can be very high in certain locations. The stresses are typically largest in one corner where the hot side flow first meets the coldest portion of the cooling flow. In an opposite corner where the coldest hot side flow meets the hottest cold side flow the temperature difference is much less resulting in unbalanced stresses across the heat exchanger structure. Increasing temperatures and pressures can result in stresses on the structure that can exceed material and assembly capabilities.

Turbine engine manufactures utilize heat exchangers throughout the engine to cool and condition airflow for cooling and other operational needs. Improvements to turbine engines have enabled increases in operational temperatures and pressures. The increases in temperatures and pressures improve engine efficiency but also increase demands on all engine components including heat exchangers.

Turbine engine manufacturers continue to seek further improvements to engine performance including improvements to thermal, transfer and propulsive efficiencies.

SUMMARY

In a featured embodiment, a cast plate heat exchanger includes a first surface including a first surface inlet end and a first group of augmentation features defining a first average density of augmentation features across the first surface. A second surface is in heat transfer communication with the first surface. The second surface includes a second surfaces inlet end and a second group of augmentation features defining a second average density of augmentation features across the second surface. A total augmentation feature density ratio is defined from the first average density of augmentation features to the second average density of augmentation features. A first region is shared by both the first surface and the second surface and covers at least a portion of the first surface inlet end. The first region includes a first region augmentation feature density ratio that is less than the total augmentation feature density ratio.

In another embodiment according to the previous embodiment, the first region covers at least a portion of the second surface inlet end.

In another embodiment according to any of the previous embodiments, the first region extends a length not more than 10% of a total length between the first surface inlet end and a first surface outlet end.

In another embodiment according to any of the previous embodiments, the first region augmentation feature density ratio is up to 20% less than the total augmentation feature density ratio.

In another embodiment according to any of the previous embodiments, the first region augmentation feature density ratio is up to 15% less than the total augmentation feature density ratio.

In another embodiment according to any of the previous embodiments, the density of augmentation features in the second group is up to 225% greater than a density of augmentation features in the first group within the first region.

In another embodiment according to any of the previous embodiments, the density of augmentation features in the second group is up to 200% greater than a density of augmentation features in the first group within the first region.

In another embodiment according to any of the previous embodiments, the first group of augmentation features and the second group of augmentation features include at least one of a trip strip, a depression and a pedestal integrally formed as part of one of the first surface and the second surface.

In another embodiment according to any of the previous embodiments, the first group of augmentation features and the second group of augmentation features include augmentation features that are the same.

In another embodiment according to any of the previous embodiments, the first group of augmentation features and the second group of augmentation features include differently shaped augmentation features.

In another embodiment according to any of the previous embodiments, the second surface includes an outer surface exposed to a cooling flow and the first surface comprises an inner surface exposed to a hot flow.

In another embodiment according to any of the previous embodiments, the first region is disposed adjacent a joint between the cast plate heat exchanger and a manifold.

In another embodiment according to any of the previous embodiments, the first region is disposed adjacent a joint between the cast plate heat exchanger and another structure.

In another embodiment according to any of the previous embodiments, the outer surface is disposed between fins.

In another embodiment according to any of the previous embodiments, the inner surface includes internal walls separating a plurality of passages for the hot flow.

In another featured embodiment, a cast plate heat exchanger includes a plate portion including outer surfaces, a leading edge, a trailing edge, and internal passages in heat transfer communication with the outer surfaces. A first group of augmentation features on walls of the internal passages is disposed between an inlet side and an outlet side. The first group of augmentation features defines a first average density of augmentation features. A second group of augmentation features is on the outer surfaces. The second group of augmentation features define a second average density of augmentation features. A total augmentation feature density ratio is defined from the first average density of augmentation features to the second average density of augmentation features. A first region shared by both the first group and the second group includes a first region augmentation feature density ratio that is less than the total augmentation feature density ratio.

In another embodiment according to the previous embodiment, the plate portion includes a total length between the inlet side and the outlet side and a length of the first region is no more than 10% of the total length from the inlet side.

In another embodiment according to any of the previous embodiments, fin portions extend from the outer surfaces and the second group of augmentation features are disposed between the fin portions.

In another embodiment according to any of the previous embodiments, the first region augmentation feature density is up to 20% less than the total augmentation feature density ratio.

In another embodiment according to any of the previous embodiments, the second average density of augmentation features is up to 225% greater than the first average density of augmentation features within the first region.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
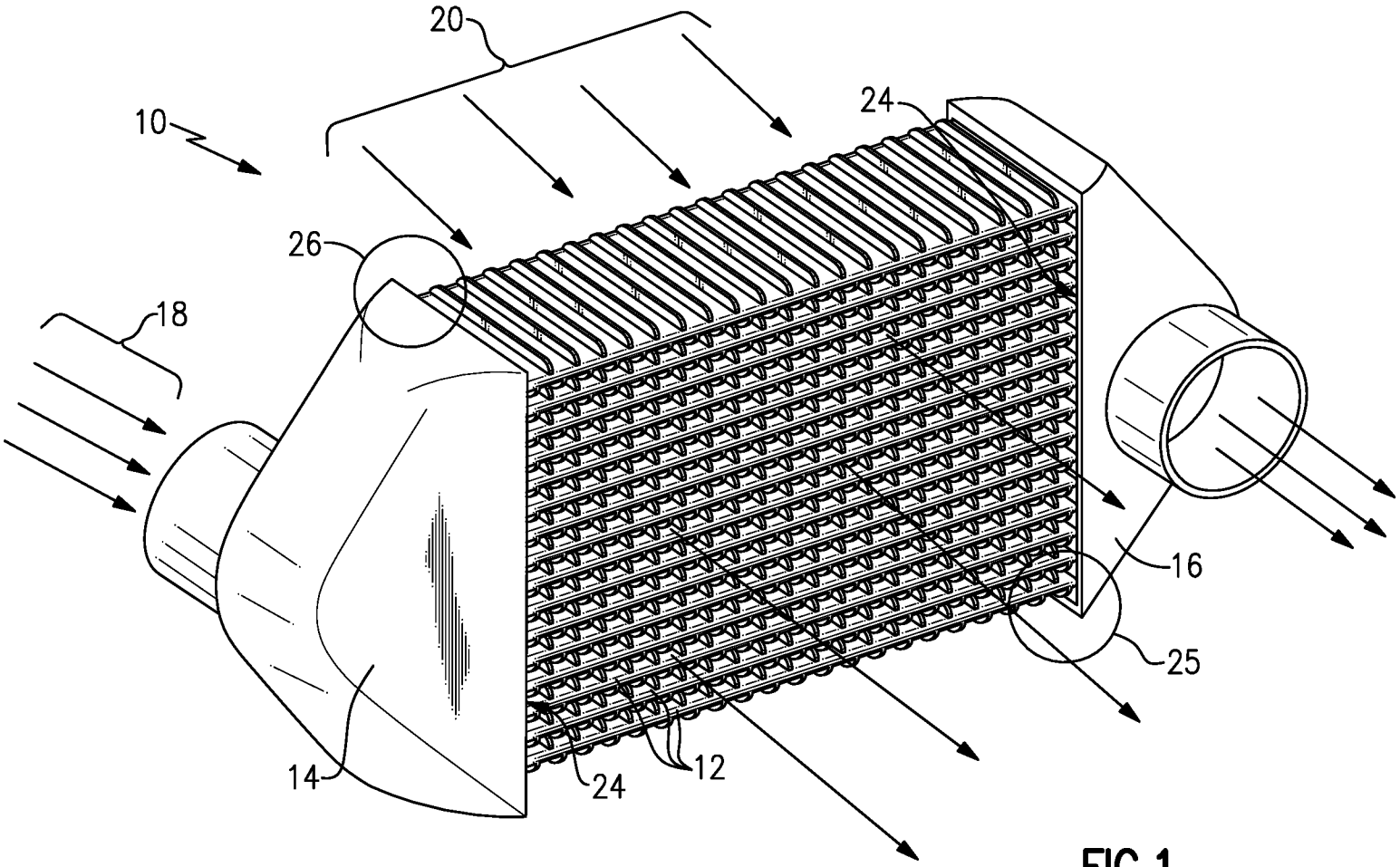
FIG. 1 is a perspective view of an example heat exchanger assembly.

Referring to FIG. 1, an example heat exchanger is schematically shown and indicated at 10 and includes a plurality of plates 12 disposed between an inlet manifold 14 and an outlet manifold 16. Each of the plates 12 include internal passages for hot airflow 18 and external surfaces exposed to a cooling airflow 20. The plates 12 are one single unitary part that is either cast or formed using other manufacturing techniques that provide a one piece part. The plates 12 are secured to the inlet manifold 14 at a first joint 22 and to the outlet manifold 16 at a second joint 24. The joints 22 and 24 are exposed to differences in temperature between the cooling airflow 20 and the hot airflow 18.

In the example heat exchanger 10 a high temperature gradient area schematically shown at 26 is located at a position where the coolest of the cooling airflow 20 meets the hottest of the hot flow 18. In the area 26, a thermal gradient between cooling airflow 20 and hot airflow within the plates 12 is at its greatest. In contrast, an opposite corner 25 wherein the hottest of the cooling airflow 20 and the coolest of the hot flow 18 meet generates the smallest thermal gradient. The difference in thermal gradients within the areas 26 and 25 can create stresses within the joints 22 and 24.

Figure 3:
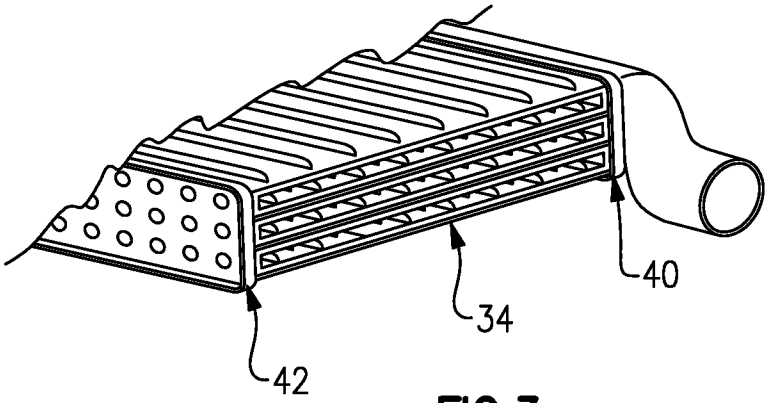
FIG. 3 is a perspective view of a portion of the example heat exchanger assembly.
Figure 2:
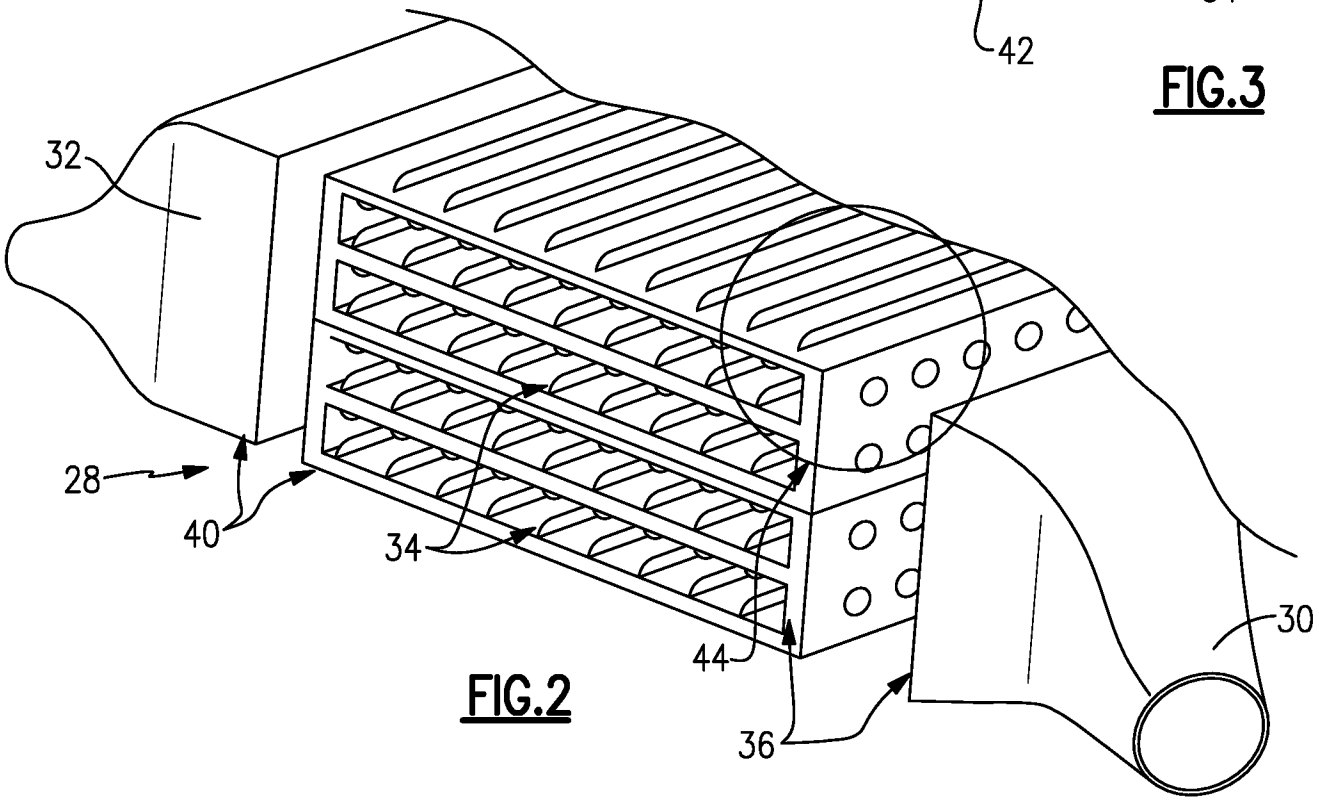
FIG. 2 is an exploded view of another example heat exchanger assembly.

Referring to FIGS. 2 and 3 with continued reference to FIG. 1, another heat exchanger assembly 28 is schematically shown and includes a plurality of plates 34 attached to an inlet manifold 30 at a first joint 36. The plates 34 are also attached to an outlet manifold 32 at an outlet joint 40. Each of the joints 36 and 40 encounter mechanical stresses caused by uneven thermal gradients within each of the plate structure 34 caused by the differences in temperature between the cooling airflow 20 and the hot airflow 18. In this example, a high stress area indicated at 44 along with lower stresses throughout other areas create mechanical stresses that are most evident in the joints 36 and 40.

Each of the disclosed example plates 34 include features to reduce the thermal gradients relative to the high stress locations to reduce mechanical stresses. It should be appreciated that although joints are shown and described by way of example that other high stress locations and interfaces are within the contemplation of this disclosure.

Figure 5:
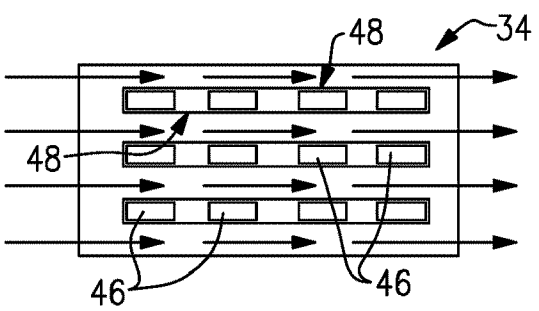
FIG. 5 is another schematic cross-section of the example plate.
Figure 4:
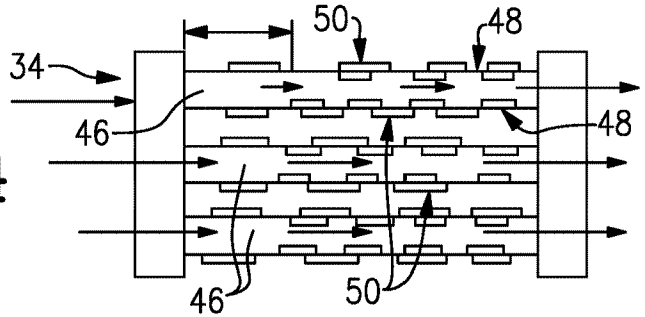
FIG. 4 is a schematic cross-section along a longitudinal plane of a portion of an example plate.

Referring to FIGS. 4 and 5, each of the example plates 12, 34 include inner passages 46 with inner surfaces that are disposed in heat transfer communication with adjacent outer surfaces. In this disclosure heat transfer communication is used to describe opposing surfaces of a common wall, or adjacent wall through which thermal energy is transferred.

In each of the plates 12, 34 the inner passages 46 are separated from the outer surface 48 by a common wall. The inner surfaces defined by the passages 46 are exposed to hot flow 18 and the outer surface 48 is exposed to cooling airflow 20. In this example embodiment, each of the outer surface 48 and the passages 46 include heat augmentation features 50. The augmentation features 50 improve thermal transfer between the hot and cold flows by providing additional surface area and by tailoring flow properties to further enhance thermal transfer.

The augmentation features 50 are arranged in a density for a defined area to tailor thermal transfer to minimize mechanical stresses. Variation of heat augmentation density between augmentation features 50 on the outer surface 48 and the passages 46 enable tailoring of thermal transfer and thereby enable adjustment of thermal gradients to reduce stresses on a joint such as the joint schematically indicated at 56.

An equal number of augmentation features disposed in the passage 46 and on the outer surface 48 does not consider thermal differences across the plate 12, 34. The example disclosed plates 12, 34 include groups of augmentation features 50 that are proportionally arranged to reduce thermal gradients relative to mechanical interfaces such as the example joint 56.

Figure 7:
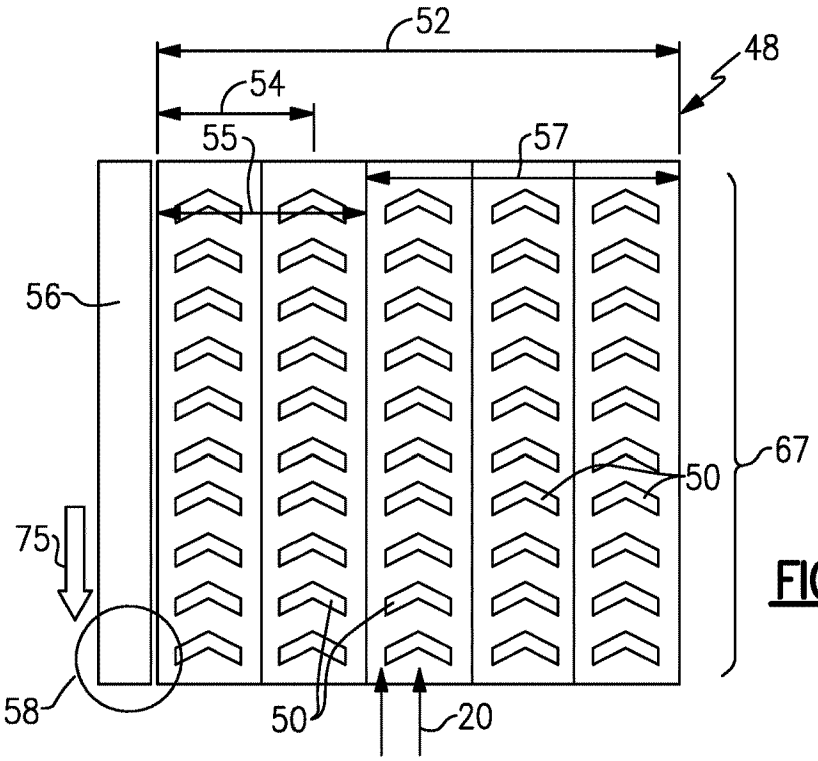
FIG. 7 is a schematic view of augmentation features arranged on an outer surface of the example plate.
Figure 6:
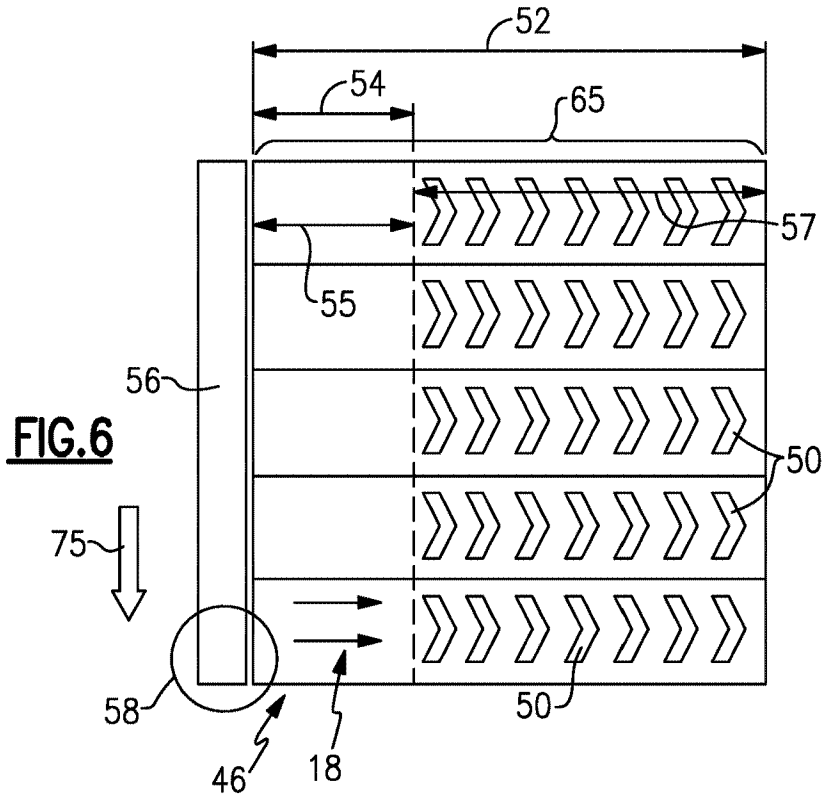
FIG. 6 is a schematic view of augmentation features arranged in internal passages of the example plate.

Referring to FIGS. 6 and 7 with continued reference to FIGS. 4 and 5, the internal passages 46 are schematically illustrated in FIG. 6 and include a group of augmentation features 50 that improve the transfer of thermal energy from the hot airflow 18 through the passage walls into the outer surface 48.

Both the internal passages 46 and outer surface 48 are shown adjacent to a joint 56. The example joint 56 is an interface that includes mechanical stresses that are greatest in the region 58. Stresses in the joint 56 increase in a direction indicated by arrow 75 toward the region 58. The example plates 12, 34 include a disclosed relative arrangement of augmentation features to provide more uniform thermal gradients that reduce stresses in the joint 56. Moreover, although a joint 56 is illustrated schematically by way of example, any interface subject to mechanical stress would benefit from the features described in this disclosure.

In the plates 12 and 34 the outer surface 48 is on top and bottom surfaces and is heat transfer communication with the walls of the passages 46. The example plates 12, 34 include a length 52 that begins at the joint 56 and extends the entire length of the passages 46. A first region 55 is disposed within a length 54 from the joint 56 and a second region 57 is disposed at the end of the first region 55 to the end of the plate 12, 34. In one disclosed embodiment the first region 55 is disposed within the length 54 that is no more than 10% of the total length 52. In another disclosed embodiment, the first region 55 is within the length 54 that is no more than 7% of the total length.

Within the first region 55, the number of augmentation features 50 within the passages 46 is different than the number of augmentation features 50 within the same first region 55 on the outer surface 48. It should be understood, that variation in the number of augmentation features is discloses by way of example, but any difference in number, structure, shape of the augmentation features that changes the thermal transfer capability through the adjoining wall could be utilized and is within the contemplation of this disclosure.

In the example disclosed in FIGS. 6 and 7, the outer surface 48 includes a second group 67 of augmentation features 50 that includes an equal number of augmentation features 50 disposed at a uniform density along the entire length 52 to define a second average density of augmentation features. The passage 46 includes a first group 65 of augmentation features 50 that define a first average density of augmentation features for all the augmentation features across the length 52. The first average density of augmentation features and the second average density of augmentation features are related according to a total augmentation feature density ratio that relates augmentation features in the first and second groups to each other.

In the disclosed example, the passage 46 does not include any augmentation features within the first region 55. Accordingly, a ratio of the first group of augmentation features to the second group of augmentation features within the first region is different than for than the total augmentation feature density of augmentation features. In one disclosed embodiment, a first region augmentation feature density ratio is less than the total augmentation feature density ratio.

In one disclosed example embodiment, a density of augmentation features 50 disposed on the outer surface 48 relative to a density of augmentation features within the passage 46 differs to vary the differing densities of heat augmentation features within the passage 46 and the outer surface 48 reduces thermal stresses in the blade and the joint.

In another disclosed embodiment, the first region augmentation feature density ratio is up to 20% less than the total augmentation feature density ratio. In this disclosed embodiment, the reduced density ratio is provided by reducing the group of first augmentation features provided in the passage 46 as compared to the group of second augmentation features 50 provided on the outer surface 48.

In yet another embodiment, the first region augmentation feature density ratio is up to 15% less than the total augmentation feature density ratio. In this example embodiment, the density of augmentation features 50 in the first group 65 within the passage 46 is reduced as compared to the second group 67 provided on the outer surface 48 within the first region 55. Although the disclosed examples include a reduction in augmentation features in the first group within the passage 46, the different ratios may also be provided by increasing the number of augmentation features within the second group on the outer surface and is within the scope and contemplation of this disclosure.

In another disclosed embodiment, the density of augmentation features 50 within the second group 67 disposed on the outer surfaces 48 is up to 225% greater than the first group 65 provided in the first passage 46. In another disclosed example embodiment, the density of augmentation features 50 within the second group 67 is up to 200% greater than the first group 65 in the passages 46. The differing density of augmentation features 50 enables tailoring of thermal transfer to reduce stresses within the interface provided by the joint 56.

It should be appreciated that the application of additional heat transfer augmentation devices within the passage 46 increases heat flow into the material. In contrast, the reduction of heat transfer augmentation devices within the passages 46 reduces the heat flow into that region thereby reducing material stresses. Additionally, the addition of augmentation features 50 on the outer surface 48 will increase heat flow out of that region. Accordingly, specific tailoring of densities of augmentation features 50 within the passages 46 and the outer surface 48 within the first region 54 enables modification and tailoring of thermal gradients to reduce stresses on the joint 56.

Figure 9:
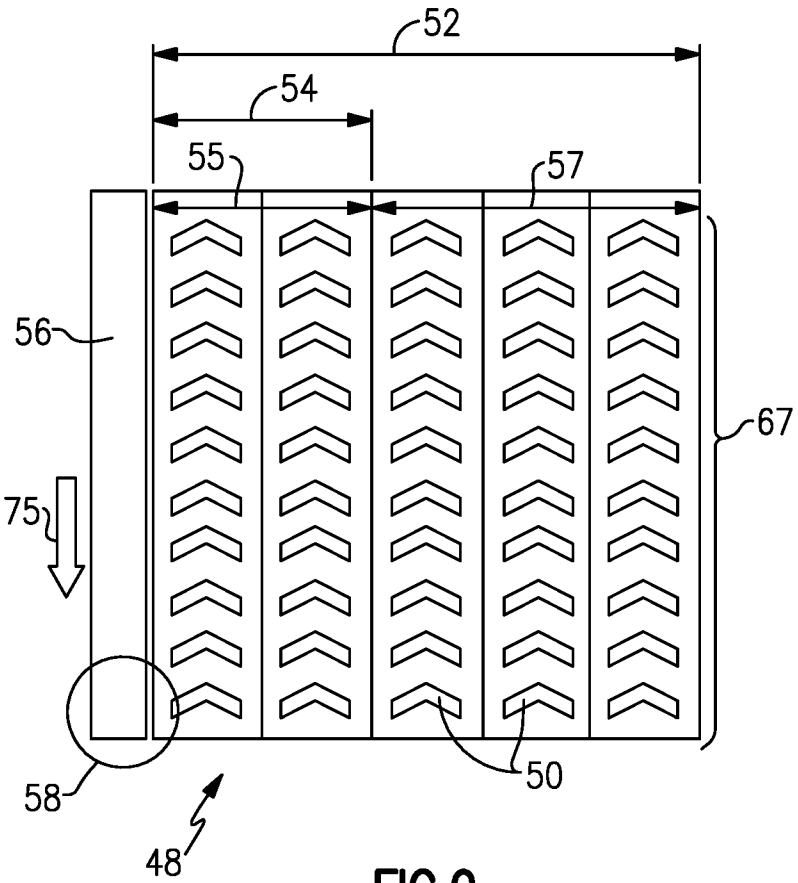
FIG. 9 is another schematic view of augmentation features arranged on the outer surface of the example plate.
Figure 8:
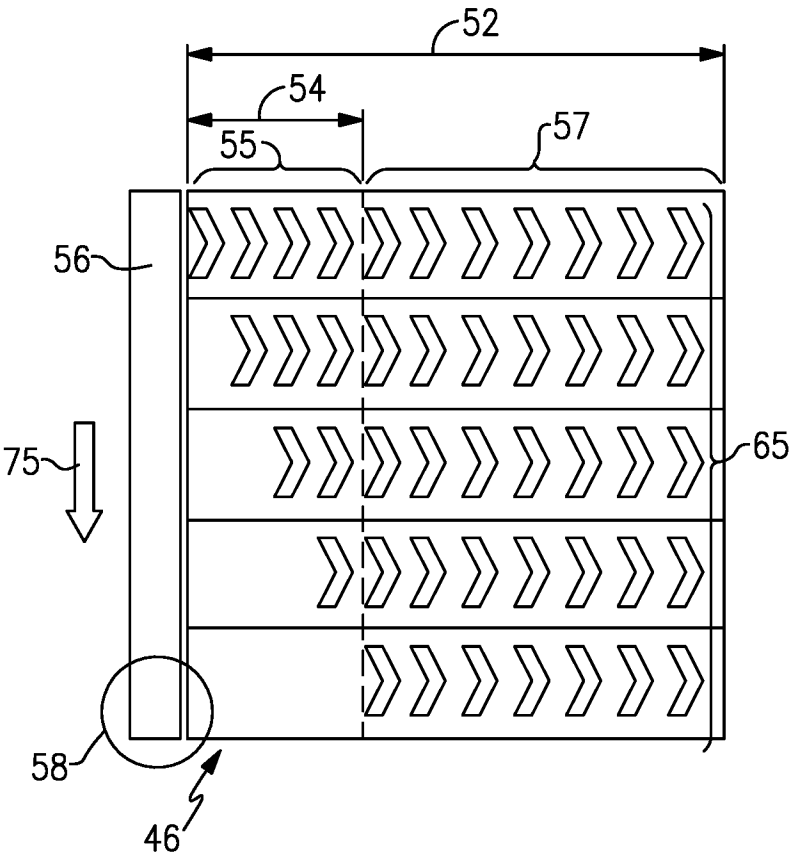
FIG. 8 is another schematic view of augmentation features arranged within internal passages of the example plate.

Referring to FIGS. 8 and 9, another example plate 12, 34 is schematically shown to illustrate another example relative orientation between augmentation features 50 within the passages 46 and the outer surface within the first region 54.

In this example the density of augmentation features 50 within the passage 46 is increased in a direction away from the high stress area indicated at 58. The density of augmentation features 50 provided on the outer surface 48 remain the same. Increasing the density of augmentation features 50 in a direction away from the highest stress region 58 within the passages 46 provides desired reduction in thermal gradients that matches stresses within the joint 56. Arrow 75 indicates a direction of increasing stress in the joint 56. The density of augmentation features 50 within the passages 46 is increased in a direction opposite the increasing stress indicated by arrow 75. The reduced number of augmentation features 50 reduce the thermal transfer in that region to provide a more uniform thermal gradient across the plate 12, 34.

Figure 10A:
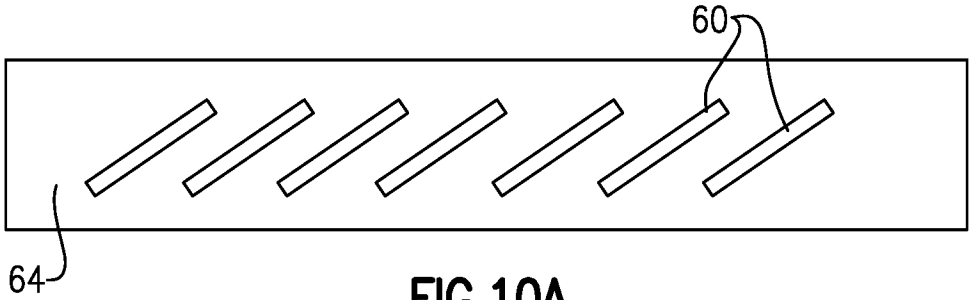
FIG. 10A is a top view of example augmentation features within an internal passage.
Figure 10B:
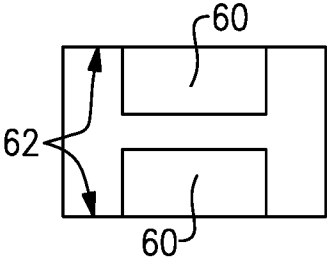
FIG. 10B is a side view of augmentation features within an internal passage.

Referring to FIGS. 10A and 10B, an example passage 46 is shown including a plurality of trip strips 60. The trip strips 60 extend from top and bottom walls 62 of the passage 64. In this example, the trip strips 60 are integrally formed into the walls 62 to both increase surface area and tailor flow properties of the hot flow 18 to increase thermal transfer.

Figure 11A:
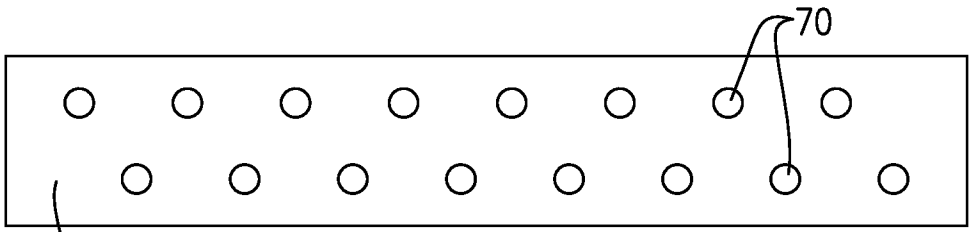
FIG. 11A is a top view of another augmentation feature within the internal passage.
Figure 11B:
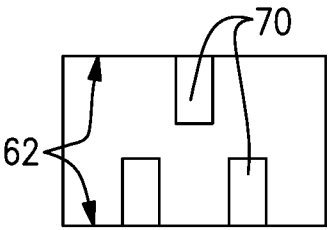
FIG. 11B is a cross-sectional view of the augmentation features shown in FIG. 11A within the internal passage.

Referring to FIGS. 11A and 11B, another passage 66 is schematically shown and includes augmentation features in the form of pedestals 70 that extend from walls 62 of the passage 66.

Figure 12A:
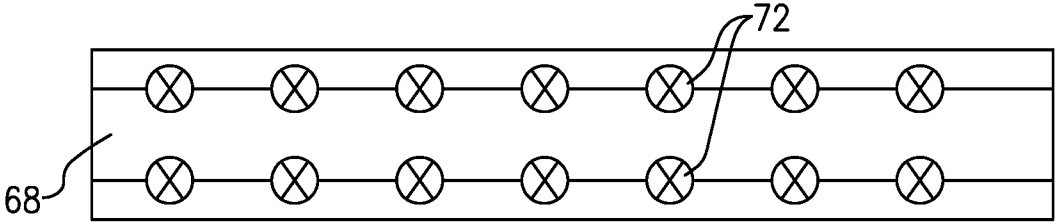
FIG. 12A is top view of yet another augmentation feature within the internal passage.
Figure 12B:
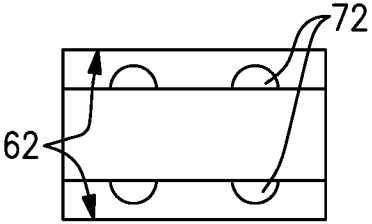
FIG. 12B is a cross-sectional view of the augmentation features within the internal passage shown in FIG. 12A.

Referring to FIGS. 12A and 12B, augmentation features formed as indentations or dimples 72 are provided along the walls 62 of the passage 68. The dimples 72 provide additional surface area along enable the flow to be modified to improve thermal transfer.

Figure 13A:
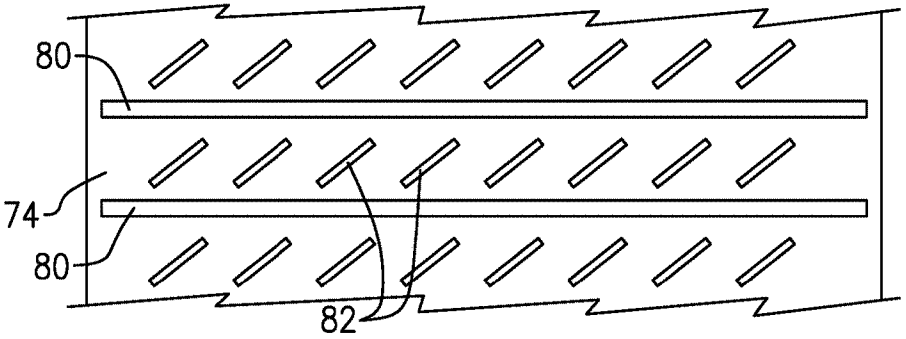
FIG. 13A is a top view of augmentation features on an outer surface.
Figure 13B:
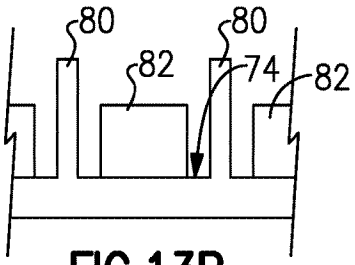
FIG. 13B is a side view of the augmentation features shown in FIG. 13A.

Referring to FIGS. 13A and 13B, an example outer surface 74 is shown and includes fins 80 and trip strips 82 between the fins 80. The trip strips 82 extend from the outer surface 74 and provide additional surface area for thermal transfer. Moreover, the example trip strips 82 are shown as simple angled walls that can direct flow against the fins 80 to provide additional thermal transfer.

Figure 14A:
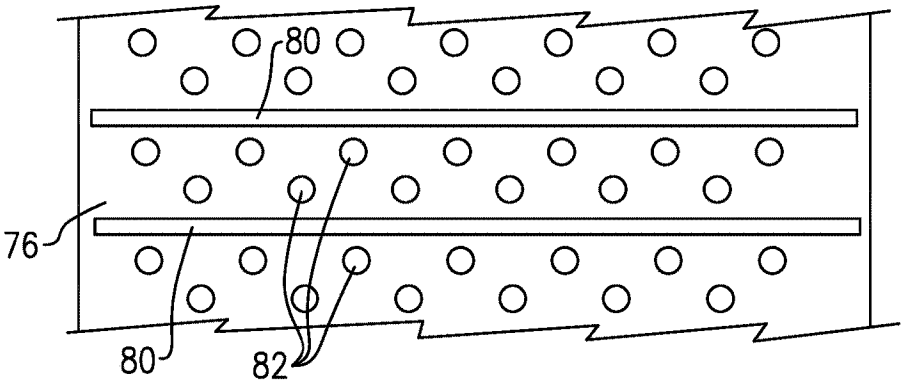
FIG. 14A is a top view of another example group of augmentation features on the outer surface.
Figure 14B:
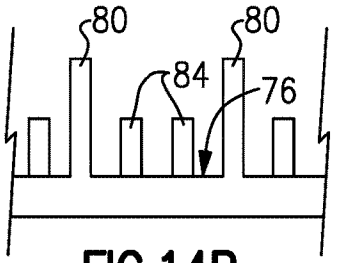
FIG. 14B is a side view of the augmentation features shown in FIG. 14A.

Referring to FIGS. 14A and 14B, another outer surface 76 is illustrated with pedestals 84 disposed between the fins 80. The pedestals 84 extend upward between the fins to enable tailoring of thermal transfer and cooling airflow 20 properties.

Figure 15A:
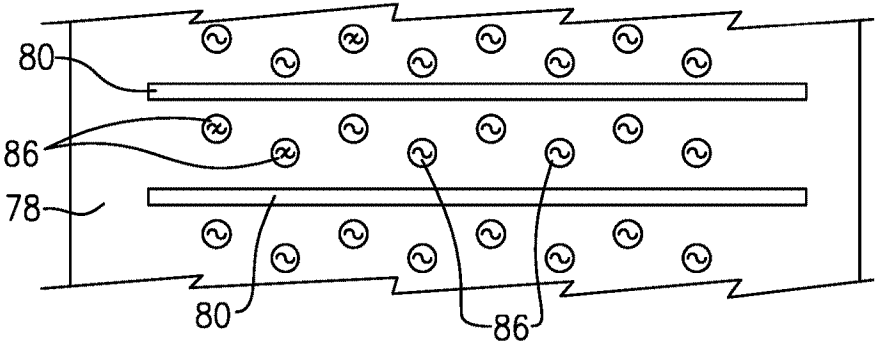
FIG. 15A is top view of yet another group of augmentation features on the outer surface.
Figure 15B:
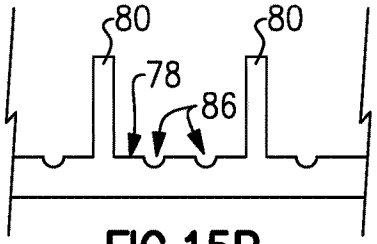
FIG. 15B is a side view of the augmentation features shown in FIG. 15A.

Referring to FIGS. 15A and 15B, yet another example outer surface 78 is disclosed including dimples 86 disposed between the fins 80. The dimples 86 provide for flow conditioning of cooling airflow between the fins 80 as well as improved thermal transfer properties.

It should be appreciated, that although several example augmentation feature structures have been disclosed by way of example, that other shapes, sizes and relative orientations could also be utilized and are within the contemplation of this disclosure.

The example disclosed augmentation features formed as integral portions of surfaces of each of the plates on both the inner and outer surfaces in a targeted manner to tailor thermal gradients to reduce thermal stresses relative to interfaces and joints.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A cast plate heat exchanger comprising: an internal passage extending from a first inlet end to a first outlet end; a first longitudinal length extending from the first inlet end to the first outlet end; an inner surface of the passage including a first group of augmentation features disposed along the first longitudinal length at a first density across the inner surface; an outer surface extending from a second inlet end to a second outlet end, the outer surface being in heat transfer communication with the inner surface; a second longitudinal length disposed transverse to the first longitudinal length and extending from the second inlet end to the second outlet end; a second group of augmentation features disposed transverse to the first group of augmentation features and at a second density across the outer surface; a first region including portions of both the inner surface and the outer surface adjacent at least a portion of the first inlet end, wherein the first density of the first group of augmentation features varies in a direction along the first longitudinal length and within the first region and the second density of the second group of augmentation features is greater than the first density of the first group of augmentation features.

2. The cast plate heat exchanger as recited in claim 1, wherein the first region covers at least a portion of the second surface inlet end.

3. The cast plate heat exchanger as recited in claim 1, wherein the inner passage extends between the first inlet end and a first outlet end and the first region extends a longitudinal length that is not more than 10% of distance between the first inlet end and a first outlet end.

4. The cast plate heat exchanger as recited in claim 1, wherein the first density of augmentation features is up to 20% less than the second density of augmentation features within the first region.

5. The cast plate heat exchanger as recited in claim 1, wherein the first density of augmentation features is up to 15% less than the second density of augmentation features within the first region.

6. The cast plate heat exchanger as recited in claim 1, wherein the second density of augmentation features is up to 225% greater than the first density of augmentation features within the first region.

7. The cast plate heat exchanger as recited in claim 1, wherein the second density of augmentation features in the second group is up to 200% greater than the first density of augmentation features in the first group within the first region.

8. The cast plate heat exchanger as recited in claim 1, wherein the first group of augmentation features and the second group of augmentation features comprise at least one of a trip strip, a depression and a pedestal.

9. The cast plate heat exchanger as recited in claim 8, wherein the first group of augmentation features and the second group of augmentation features include augmentation features that are shaped the same.

10. The cast plate heat exchanger as recited in claim 8, wherein the first group of augmentation features and the second group of augmentation features include differently shaped augmentation features.

11. The cast plate heat exchanger as recited in claim 1, wherein the outer surface is disposed to provide for exposure to a cooling flow and the inner surface is disposed to provide for exposure to a hot flow.

12. The cast plate heat exchanger as recited in claim 1, wherein the first region is disposed adjacent a joint between the cast plate heat exchanger and a manifold.

13. The cast plate heat exchanger as recited in claim 1, wherein the outer surface is disposed between fins.

14. The cast plate heat exchanger as recited in claim 13, wherein the inner surface comprises internal walls separating a plurality of passages for the hot flow.

15. The cast plate heat exchanger as recited in claim 1, wherein the first group of augmentation features is formed as an integral part of the inner surface and the second group of augmentation features are formed as an integral part of the outer surface.

16. The cast plate heat exchanger as recited in claim 1, wherein none of the first group of augmentation features are disposed within the first region.

* * * * *